US012643026B2

(12) United States Patent
Sullivan

(10) Patent No.: US 12,643,026 B2
(45) Date of Patent: Jun. 2, 2026

(54) LIGHTWEIGHT FLYING DISCS

(71) Applicant: Michael Sullivan, Thornhill (CA)

(72) Inventor: Michael Sullivan, Thornhill (CA)

( * ) Notice: Subject to any disclaimer, the term of this patent is extended or adjusted under 35 U.S.C. 154(b) by 0 days.

(21) Appl. No.: 19/279,028

(22) Filed: Jul. 24, 2025

(65) Prior Publication Data

US 2025/0345683 A1 Nov. 13, 2025

Related U.S. Application Data

(63) Continuation of application No. PCT/CA2025/050156, filed on Feb. 6, 2025.

(60) Provisional application No. 63/550,222, filed on Feb. 6, 2024.

(51) Int. Cl.
*A63B 65/10* (2006.01)
*A63B 67/06* (2006.01)

(52) U.S. Cl.
CPC ..... *A63B 65/10* (2013.01); *A63B 67/06* (2013.01); *A63B 2225/01* (2013.01)

(58) Field of Classification Search
CPC ..... A63H 33/18
USPC ..... 446/46, 47, 48
See application file for complete search history.

(56) References Cited

U.S. PATENT DOCUMENTS 2,864,201 A 12/1958 Leise
3,710,505 A * 1/1973 Linenfelser ..... A63H 33/18 473/588
4,114,885 A * 9/1978 Morrow ..... A63H 33/18 473/588
4,196,540 A * 4/1980 Hembree ..... A63H 33/18 473/588
4,205,484 A * 6/1980 Kovac ..... A63H 33/18 446/46
4,568,297 A * 2/1986 Dunipace ..... A63H 33/18 D21/443
5,078,637 A 1/1992 McFarland
5,320,361 A * 6/1994 Hellerman ..... A63H 33/18 473/588
D369,191 S 4/1996 Dunipace
5,531,624 A 7/1996 Dunipace
5,540,610 A * 7/1996 Sneddon ..... A63H 33/18 446/236
D386,222 S 11/1997 Dunipace
D388,134 S 12/1997 Dunipace
D401,288 S 11/1998 Dunipace
(Continued)

FOREIGN PATENT DOCUMENTS

CN 2649139 Y 10/2004
EP 3991819 A1 4/2022

OTHER PUBLICATIONS

"The Putter in Types of Disc Golf Discs (for Begginers)" by Kyle Labine on Simply Disc Gold dated Jan. 1, 2024, https://simplydiscgolf.com/types-of-disc-golf-discs/.

(Continued)

*Primary Examiner* — Joseph B Baldori
(74) *Attorney, Agent, or Firm* — Smart & Biggar LP

(57) ABSTRACT

Lightweight flying discs for playing flying disc games and sports, such as Frisbee™ golf and ultimate Frisbee™, for example, are provided. The discs comprise a flight plate portion and a rim portion surrounding the flight plate portion. At least the flight plate portion is formed from a lightweight and resilient material. The lightweight material can be a foam, including a polyurethane foam, for example.

27 Claims, 12 Drawing Sheets

(56) References Cited

U.S. PATENT DOCUMENTS

| | | | | |
|---|---|---|---|---|
| D401,289 | S | 11/1998 | Dunipace | |
| D402,318 | S | 12/1998 | Dunipace | |
| 6,247,989 | B1 * | 6/2001 | Neff | A63H 33/18 473/588 |
| D445,461 | S | 7/2001 | Vodhanel, Jr. | |
| 6,887,119 | B2 * | 5/2005 | Bloeme | A63H 33/18 446/46 |
| 7,096,826 | B2 * | 8/2006 | Markham | A01K 15/025 119/707 |
| 7,294,036 | B2 * | 11/2007 | Potts | A63H 33/18 473/588 |
| 7,500,900 | B2 * | 3/2009 | Wolfe, Jr. | A63H 33/18 446/460 |
| D680,280 | S | 4/2013 | Nielsen | |
| 8,474,410 | B2 * | 7/2013 | Oblack | A01K 15/025 119/709 |
| 8,784,152 | B2 * | 7/2014 | Busse | A63H 33/18 446/46 |
| 9,370,726 | B2 * | 6/2016 | Rybka | A63H 33/18 |
| 9,731,216 | B2 * | 8/2017 | Richardson | A63H 33/18 |
| 9,789,418 | B2 * | 10/2017 | Oblack | A01K 15/025 |
| D859,536 | S | 9/2019 | Cope | |
| D875,024 | S | 2/2020 | Zheng | |
| 10,881,978 | B2 | 1/2021 | Miller | |
| 11,130,071 | B1 | 9/2021 | Patrick | |
| D985,861 | S | 5/2023 | Baiocchi | |
| 12,343,655 | B2 * | 7/2025 | Stark | A63H 33/18 |
| 2004/0166764 | A1 | 8/2004 | Stark | |
| 2017/0246552 | A1 | 8/2017 | Anderson | |
| 2021/0308597 | A1 | 10/2021 | Von Heland | |
| 2023/0158418 | A1 | 5/2023 | Davis | |
| 2023/0211246 | A1 | 7/2023 | Liu | |
| 2025/0153066 | A1 * | 5/2025 | Marston, Jr. | A63H 33/18 |

OTHER PUBLICATIONS

"How to Choose the Right Golf Disc by Frisbee Rob" dated Oct. 25, 2025, https://frisbeerob.com/2015/10/25/how-to-choose-the-right-golf-disc/.

"Technical Standards—Manufacturer Guidelines for Obtaining PDGA Approval of Golf Discs and Targets", Professional Disc Gold Association, Jan. 20, 2021.

* cited by examiner

LIGHTWEIGHT FLYING DISCS

CROSS-REFERENCE TO RELATED APPLICATION

This is a continuation of International Application No. PCT/CA2025/050156 filed Feb. 6, 2025, which claims priority to U.S. Provisional Patent Application No. 63/550,222 filed Feb. 6, 2024, and the entire contents of each are hereby incorporated herein by reference.

FIELD

The present disclosure is directed generally to flying discs and flying discs sports and games, and particularly to lightweight flying discs that can be used for disc golf and ultimate Frisbee™, including for the purpose of teaching flying disc sports.

INTRODUCTION

The following paragraphs are not an admission that anything discussed in them is prior art or part of the knowledge of persons skilled in the art.

Disc golf, also known as Frisbee™ golf, is a flying disc sport that is played according to rules that are similar to golf. Players complete a hole by throwing a disc from a tee area toward a target, known as a basket, throwing again from where the previous throw landed, until the basket is reached. The baskets are formed by wire with hanging chains above the basket, designed to catch the incoming discs, which then fall into the basket. Usually, the number of throws a player uses to reach each basket is tallied (often in relation to par), and players seek to complete each hole in the lowest number of total throws.

Another flying disc sport known as ultimate Frisbee™, involves two teams of players playing on a rectangular field comprising a central zone flanked on both sides by an end zone. Players can score points by passing a disc to a teammate within the opposing team's end zone.

A flying disc recreational game that can be played is 'catch', where two or more players spaced apart from one another throw and catch a flying disc, passing the disc between one another.

Discs for flying disc sports and games can be made out of hard, non-resilient polypropylene plastic materials or hard, non-resilient polyurethane materials, which are thermoplastic polymers.

BRIEF DESCRIPTION OF THE DRAWINGS

The drawings included herewith are for illustrating various examples of apparatuses and methods of the present disclosure and are not intended to limit the scope of what is taught in any way. In the drawings.

DETAILED DESCRIPTION

Various apparatuses or methods will be described below to provide an example of an embodiment of each claimed invention. No embodiment described below limits any claimed invention and any claimed invention may cover apparatuses and methods that differ from those described below. The claimed inventions are not limited to apparatuses and methods having all of the features of any one apparatus or method described below, or to features common to multiple or all of the apparatuses or methods described below. It is possible that an apparatus or method described below is not an embodiment of any claimed invention. Any invention disclosed in an apparatus or method described below that is not claimed in this document may be the subject matter of another protective instrument, for example, a continuing patent application, and the applicant(s), inventor(s) and/or owner(s) do not intend to abandon, disclaim or dedicate to the public any such invention by its disclosure in this document.

As hereinbefore noted, discs for flying disc games and sports, such as disc golf and ultimate Frisbee™, can be made of polypropylene plastic. While considerable flying distances can be covered by such flying discs when thrown by grown-up players, younger players may not be able to achieve the same distances. Furthermore, a person situated in the flying path of a polypropylene flying disc can sustain serious injuries. For the same reasons, polypropylene discs can be difficult, and even dangerous, to catch. The teachings of the present disclosure relate to lightweight flying discs that can be used for disc golf, and other flying disc sports and games. The discs include a flight plate and a rim and can be formed of lightweight and resilient materials, including, for example, a foam material. When implementing lightweight and resilient materials, the inventor has discovered that conventional flying disc dimensions can be unsuitable, particularly because, when constructed using lightweight materials, the disc collapses and/or is severely impaired with respect to flight capabilities. To solve this problem, the inventor has discovered that, surprisingly, lightweight flying discs are feasible, provided the flying disc dimensions are adjusted. Thus, for example, an increase in the thickness of the flight plate improves the rigidity of the disc. Resulting from the materials selection and dimensions, the discs can fly well, they can be easier to throw further, and they can be easier and safer to catch.

Figure 1:
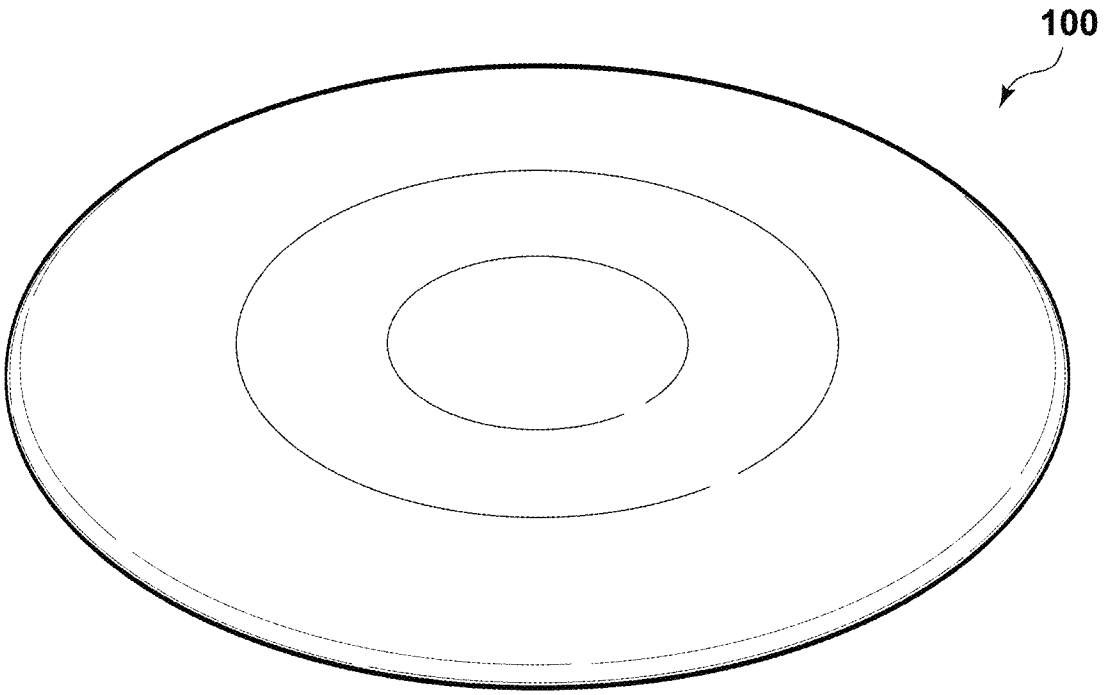
FIG. 1 is an upper perspective view of a first example of a lightweight flying disc.
Figure 2:
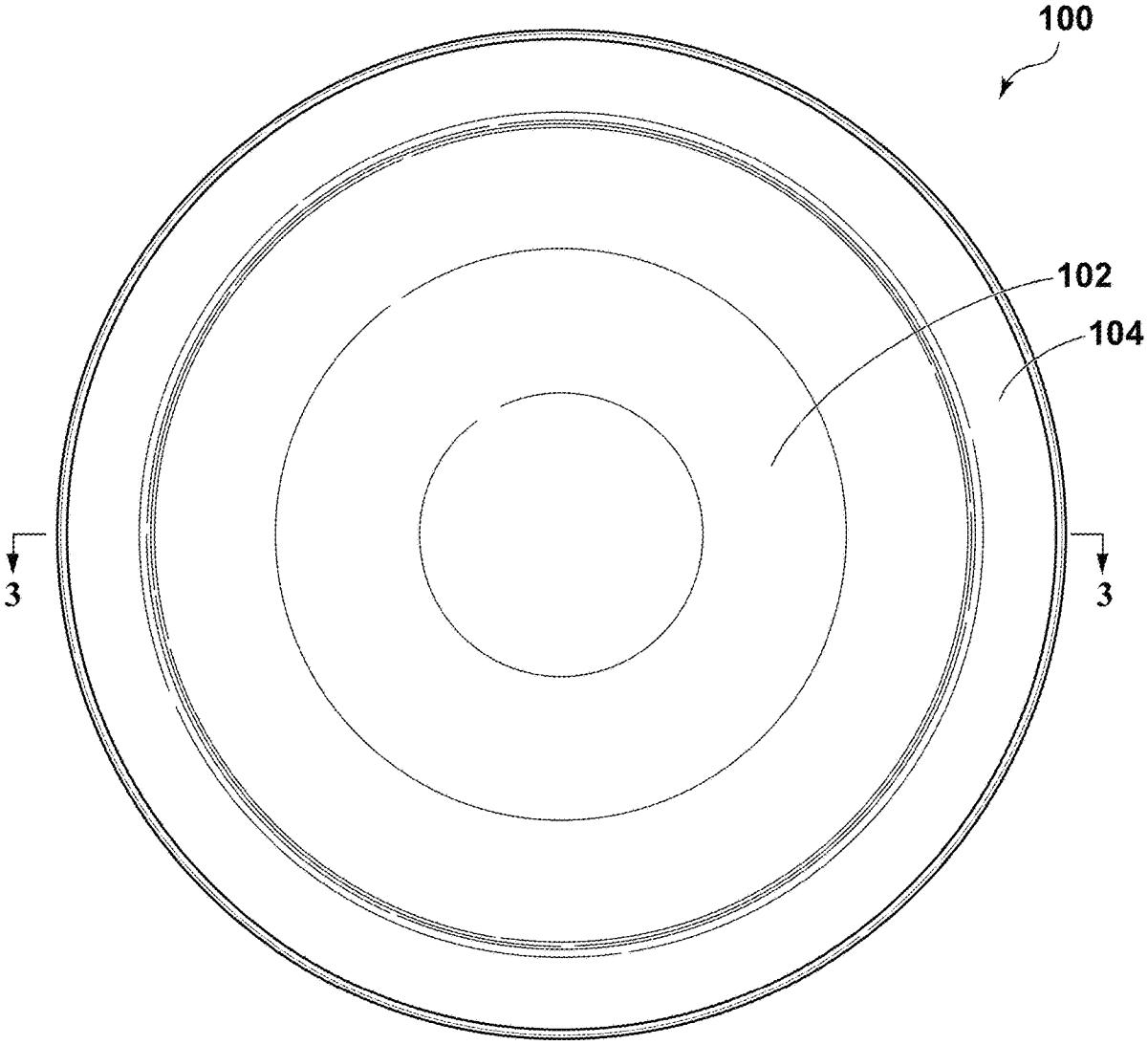
FIG. 2 is a bottom view thereof.

Referring to FIGS. 1 and 2, a lightweight flying disc is shown generally at reference numeral 100. The disc 100 has a circular, saucer-like configuration, and comprises a central flight plate 102, and an outer rim 104 that surrounds the flight plate 102.

Figure 3:
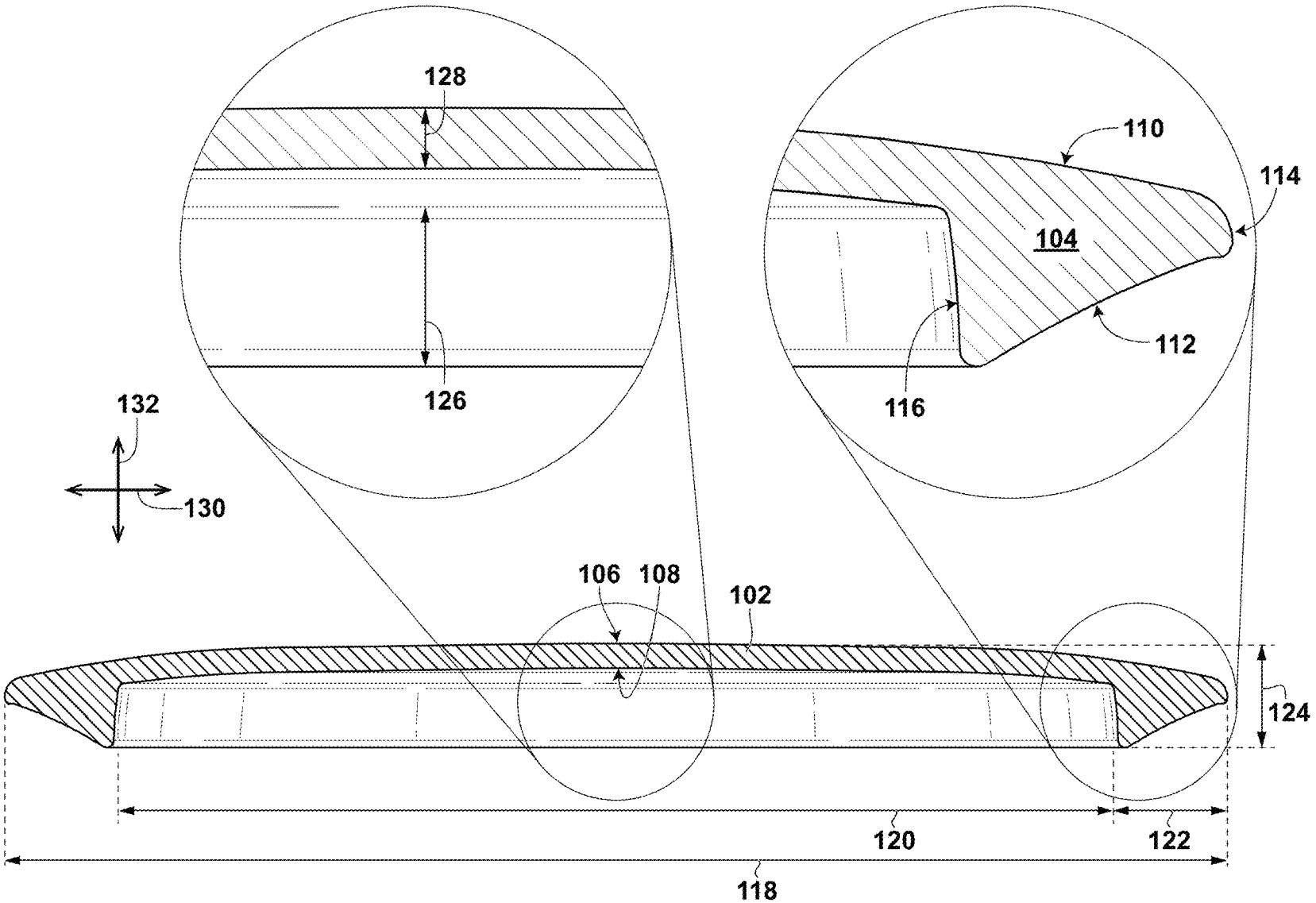
FIG. 3 is a sectional view along line 3-3 in FIG. 2.

Referring to FIG. 3, the flight plate 102 includes an upper surface 106 and a lower surface 108. The rim 104 includes an upper rim surface 110, a lower rim surface 112, and a leading edge 114 that is arranged intermediate the upper and lower rim surfaces 110, 112. The upper surface 106 adjoins the upper rim surface 110. The rim 104 further includes an inner rim wall 116 that extends between the lower surface 108 and the lower rim surface 112.

In the example illustrated, a disc diameter 118 can be defined generally as an overall width of the disc 100 in a horizontal or radial direction 130 between the leading edges 114. An inner rim diameter 120 can be defined generally as a width of the flight plate 102 in the radial direction 130. A rim width 122 can be defined generally as a width of the rim 104 in the radial direction 130. A disc height 124 can be defined generally as an overall height of the disc 100 in a vertical or axial direction 132, which is orthogonal to the radial direction 130. An inner rim height 126 can be defined generally as a height of the rim 104 in the axial direction 132 below the flight plate 102. Finally, a thickness 128 can be defined generally as a height of the flight plate 102 in the axial direction 132 at a central location of the disc 100.

Dimensions for the disc 100 are provided in Table 1. These dimensions are intended to be illustrative but non-limiting. It will be appreciated that other suitable dimensions are possible.

TABLE 1

| | | |
|---|---|---|
| Disc diameter | 118 | 211.80 mm |
| Inner rim diameter | 120 | 172.49 mm |
| Rim width | 122 | 19.66 mm |
| Disc height | 124 | 17.93 mm |
| Inner rim height | 126 | 11.05 mm |
| Central thickness | 128 | 4.20 mm |

Furthermore, the total volume for the disc 100 can be about 204.9 $cm^3$. It will be appreciated that this is an illustrative non-limiting volume, and that other suitable volumes are possible.

Moreover, the weight of disc 100 can be about 100.0 grams. It will be appreciated that this is an illustrative non-limiting weight, and that other suitable weights are possible.

Figure 4:
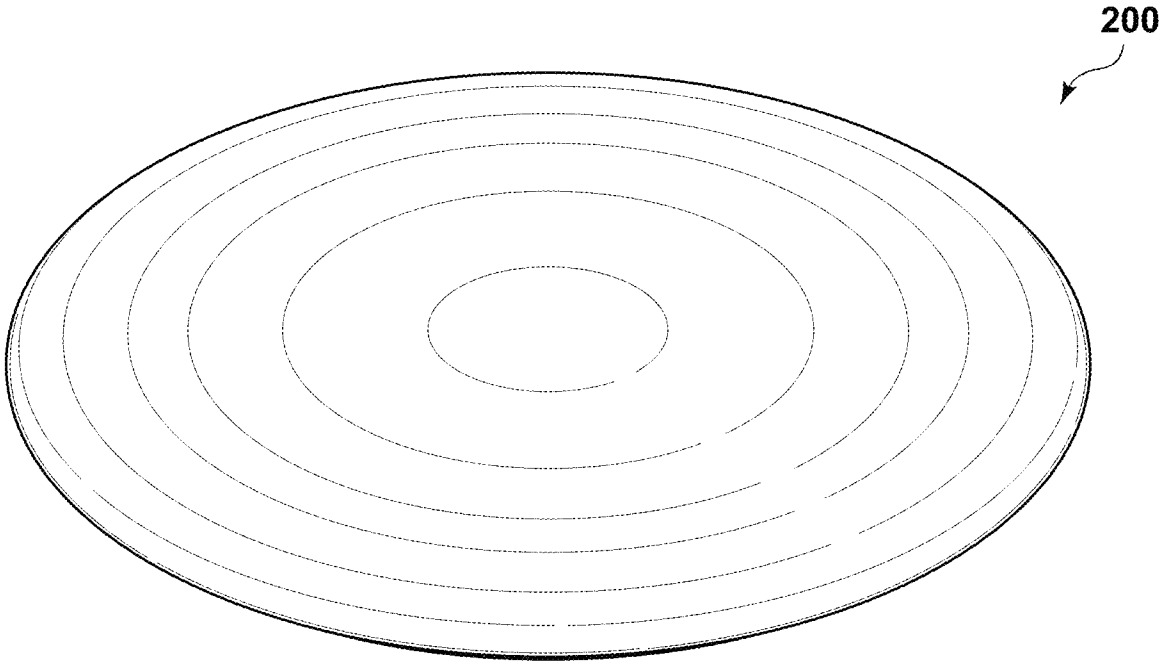
FIG. 4 is an upper perspective view of a second example of a lightweight flying disc.
Figure 5:
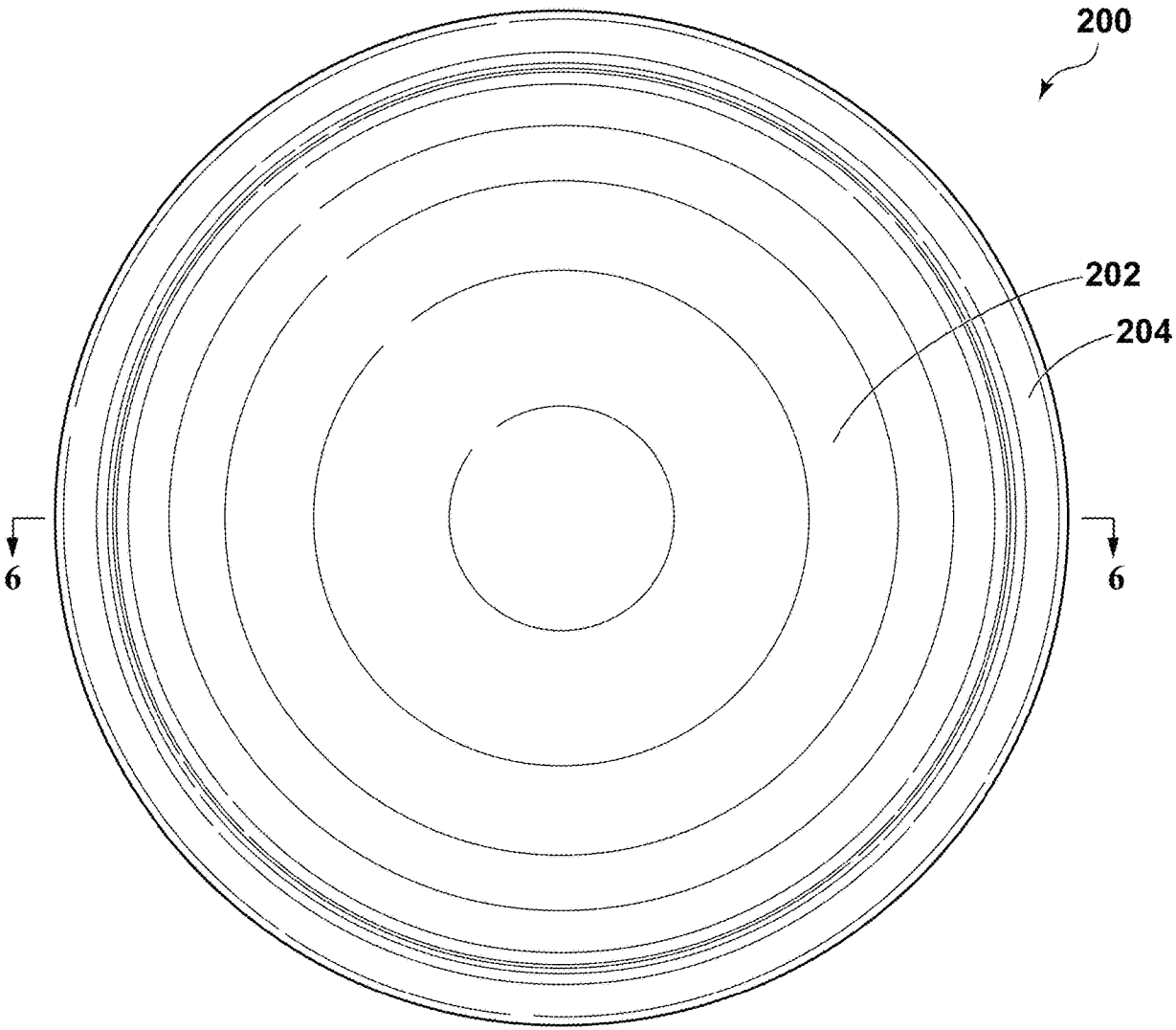
FIG. 5 is a bottom view thereof.

Referring to FIGS. 4 and 5, a lightweight flying disc is shown generally at reference numeral 200. The disc 200 has a circular, saucer-like configuration, and comprises a central flight plate 202, and an outer rim 204 that surrounds the flight plate 202.

Figure 6:
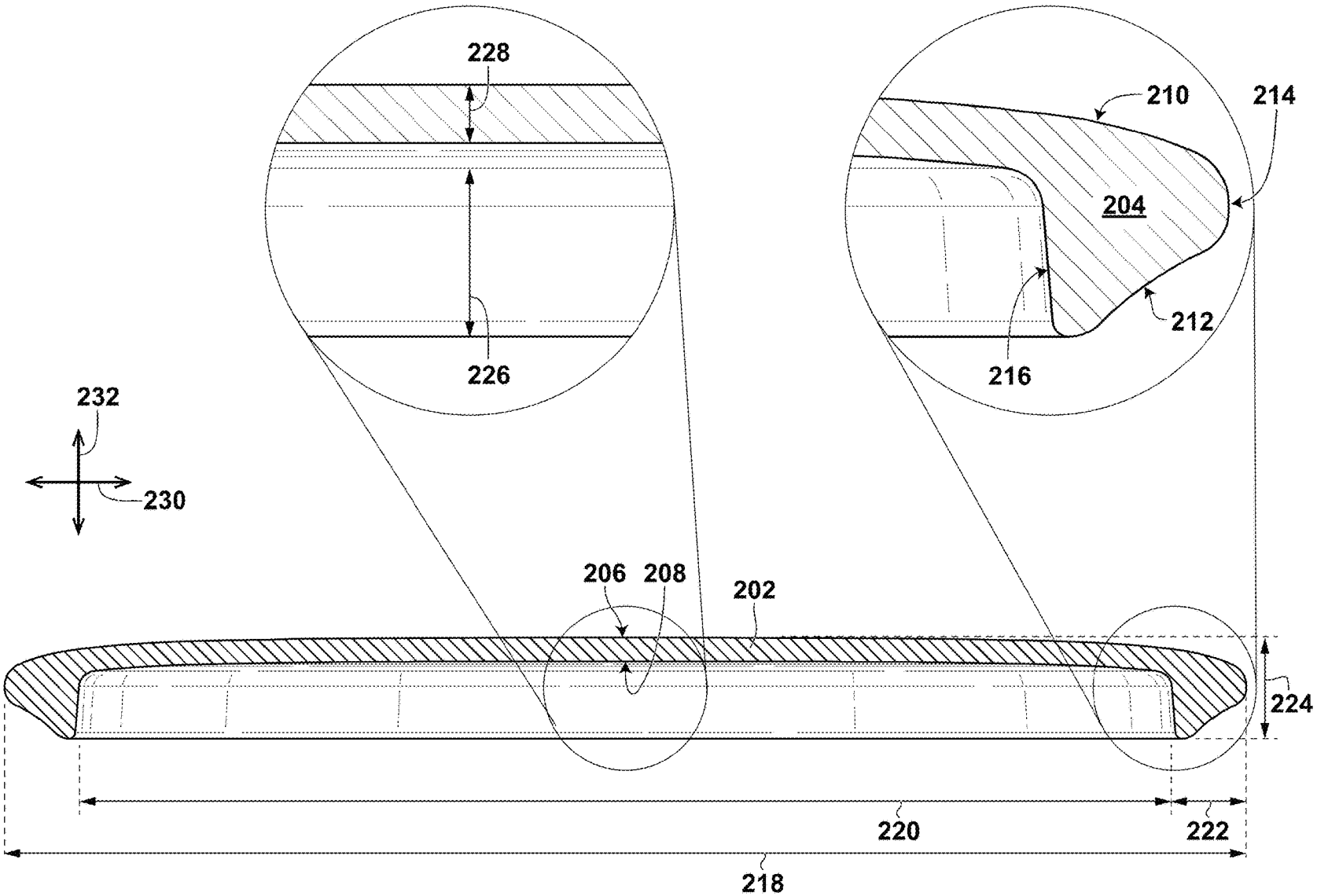
FIG. 6 is a sectional view along line 6-6 in FIG. 5.

Referring to FIG. 6, the flight plate 202 includes an upper surface 206 and a lower surface 208. The rim 204 includes an upper rim surface 210, a lower rim surface 212, and a leading edge 214 that is arranged intermediate the upper and lower rim surfaces 210, 212. The upper surface 206 adjoins the upper rim surface 210. The rim 204 further includes an inner rim wall 216 that extends between the lower surface 208 and the lower rim surface 212.

In the example illustrated, a disc diameter 218 can be defined generally as an overall width of the disc 200 in a horizontal or radial direction 230 between the leading edges 214. An inner rim diameter 220 can be defined generally as a width of the flight plate 202 in the radial direction 230. A rim width 222 can be defined generally as a width of the rim 204 in the radial direction 230. A disc height 224 can be defined generally as an overall height of the disc 200 in a vertical or axial direction 232, which is orthogonal to the radial direction 230. An inner rim height 226 can be defined generally as a height of the rim 204 in the axial direction 232 below the flight plate 202. Finally, a thickness 228 can be defined generally as a height of the flight plate 202 in the axial direction 232 at a central location of the disc 200.

Dimensions for the disc 200 are provided in Table 2. These dimensions are intended to be illustrative but non-limiting. It will be appreciated that other suitable dimensions are possible.

TABLE 2

| | | |
|---|---|---|
| Disc diameter | 218 | 216.19 mm |
| Inner rim diameter | 220 | 190.30 mm |
| Rim width | 222 | 12.95 mm |
| Disc height | 224 | 17.51 mm |
| Inner rim height | 226 | 11.71 mm |
| Central thickness | 228 | 4.09 mm |

Furthermore, the total volume for the disc 200 can be about 204.4 $cm^3$. It will be appreciated that this is an illustrative non-limiting volume, and that other suitable volumes are possible.

Moreover, the weight of disc 200 can be about 97.6 grams. It will be appreciated that this is an illustrative non-limiting weight, and that other suitable weights are possible.

Figure 7:
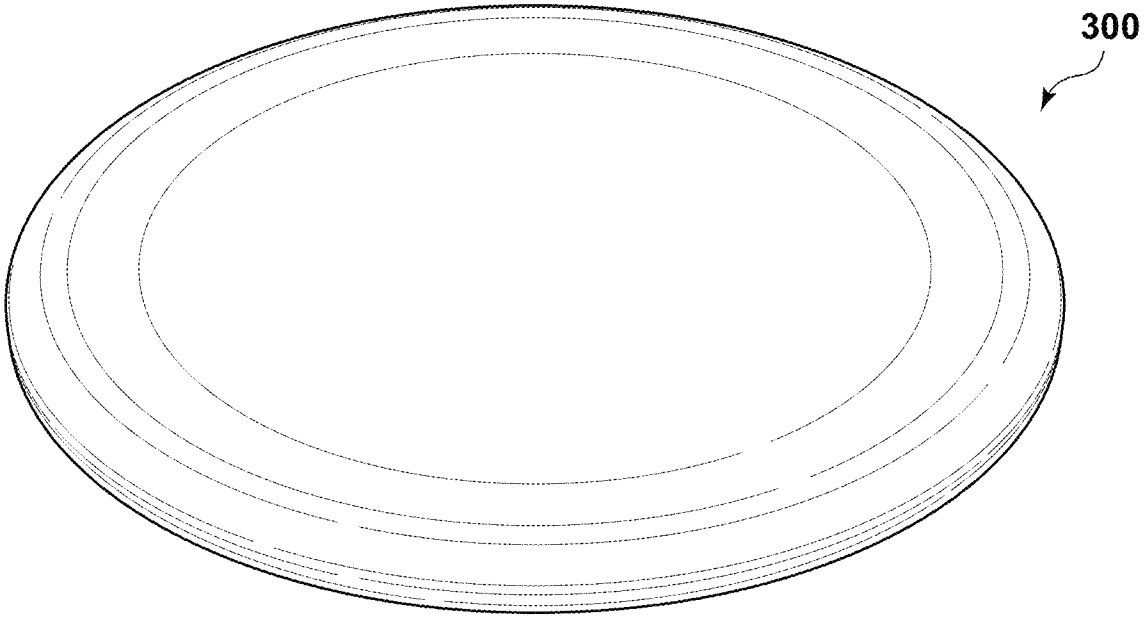
FIG. 7 is an upper perspective view of a third example of a lightweight flying disc.
Figure 8:
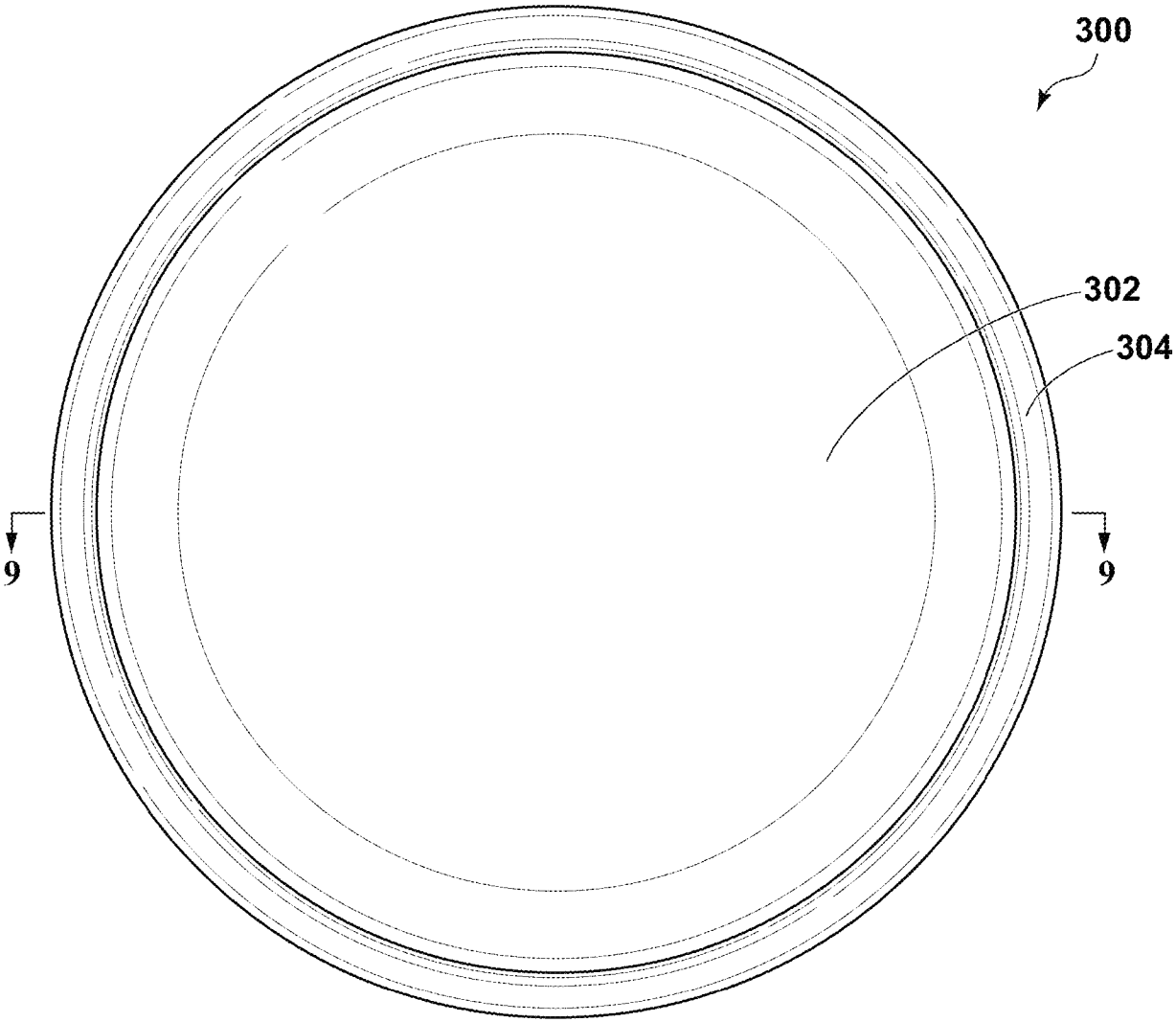
FIG. 8 is a bottom view thereof.

Referring to FIGS. 7 and 8, a lightweight flying disc is shown generally at reference numeral 300. The disc 300 has a circular, saucer-like configuration, and comprises a central flight plate 302, and an outer rim 304 that surrounds the flight plate 302.

Figure 9:
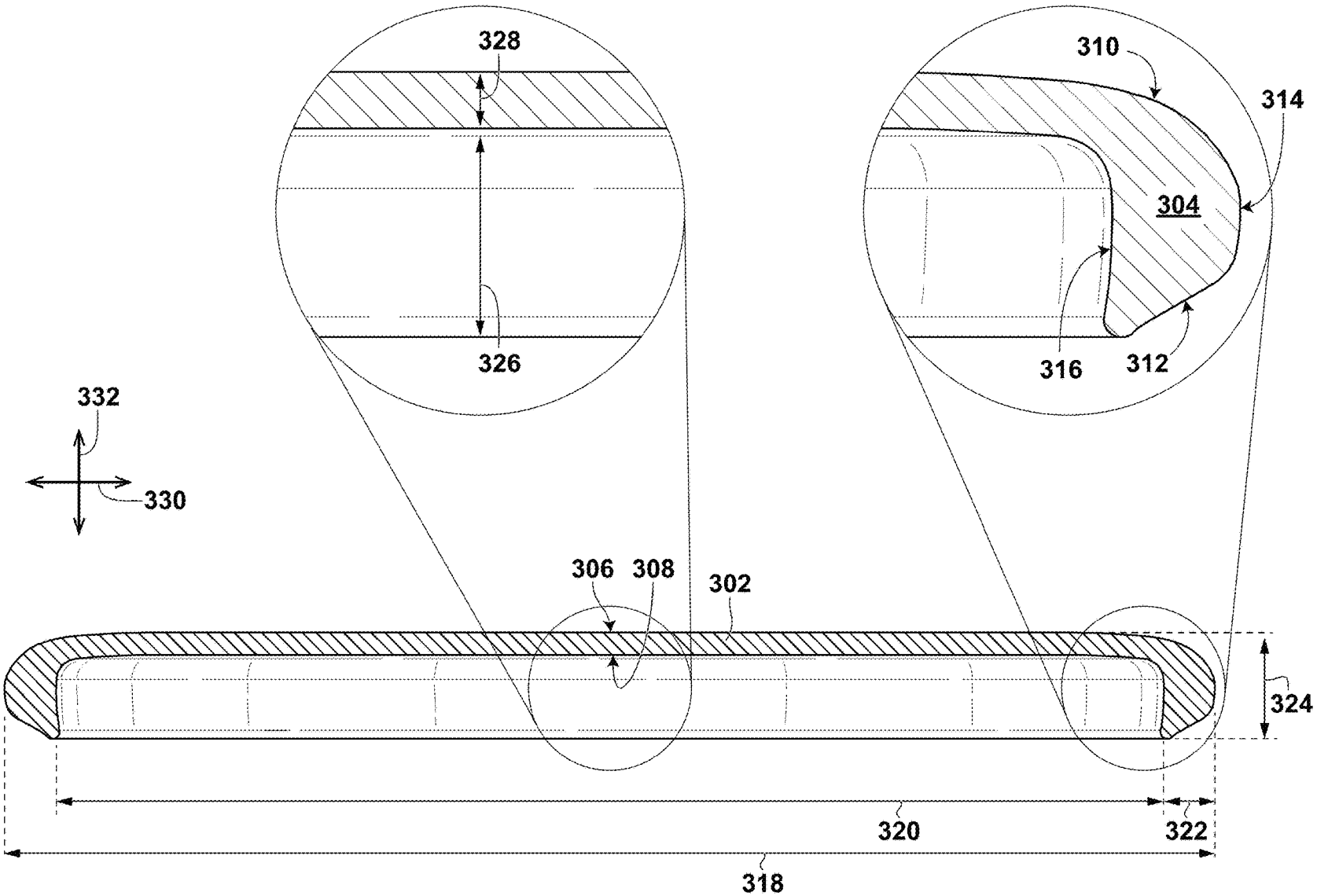
FIG. 9 is a sectional view along line 9-9 in FIG. 8.

Referring to FIG. 9, the flight plate 302 includes an upper surface 306 and a lower surface 308. The rim 304 includes an upper rim surface 310, a lower rim surface 312, and a leading edge 314 that is arranged intermediate the upper and lower rim surfaces 310, 312. The upper surface 306 adjoins the upper rim surface 310. The rim 304 further includes an inner rim wall 316 that extends between the lower surface 308 and the lower rim surface 312.

In the example illustrated, a disc diameter 318 can be defined generally as an overall width of the disc 300 in a horizontal or radial direction 330 between the leading edges 314. An inner rim diameter 320 can be defined generally as a width of the flight plate 302 in the radial direction 330. A rim width 322 can be defined generally as a width of the rim 304 in the radial direction 330. A disc height 324 can be defined generally as an overall height of the disc 300 in a vertical or axial direction 332, which is orthogonal to the radial direction 330. An inner rim height 326 can be defined generally as a height of the rim 304 in the axial direction 332 below the flight plate 302. Finally, a thickness 328 can be defined generally as a height of the flight plate 302 in the axial direction 332 at a central location of the disc 300.

Dimensions for the disc 300 are provided in Table 3. These dimensions are intended to be illustrative but non-limiting. It will be appreciated that other suitable dimensions are possible.

TABLE 3

| | | |
|---|---|---|
| Disc diameter | 318 | 210.78 mm |
| Inner rim diameter | 320 | 192.80 mm |
| Rim width | 322 | 9.50 mm |
| Disc height | 324 | 18.45 mm |
| Inner rim height | 326 | 13.94 mm |
| Central thickness | 328 | 3.90 mm |

Furthermore, the total volume for the disc 300 can be about 188.5 $cm^3$. It will be appreciated that this is an illustrative non-limiting volume, and that other suitable volumes are possible.

Moreover, the weight of disc 300 can be about 92.2 grams. It will be appreciated that this is an illustrative non-limiting weight, and that other suitable weights are possible.

Figure 10:
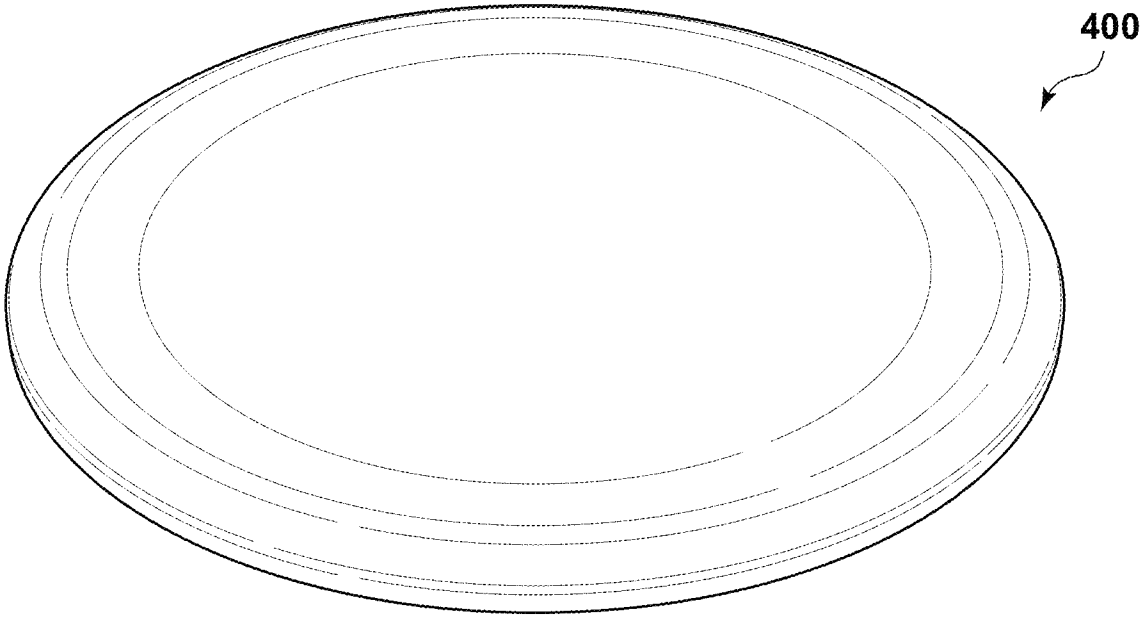
FIG. 10 is an upper perspective view of a fourth example of a lightweight flying disc.
Figure 11:
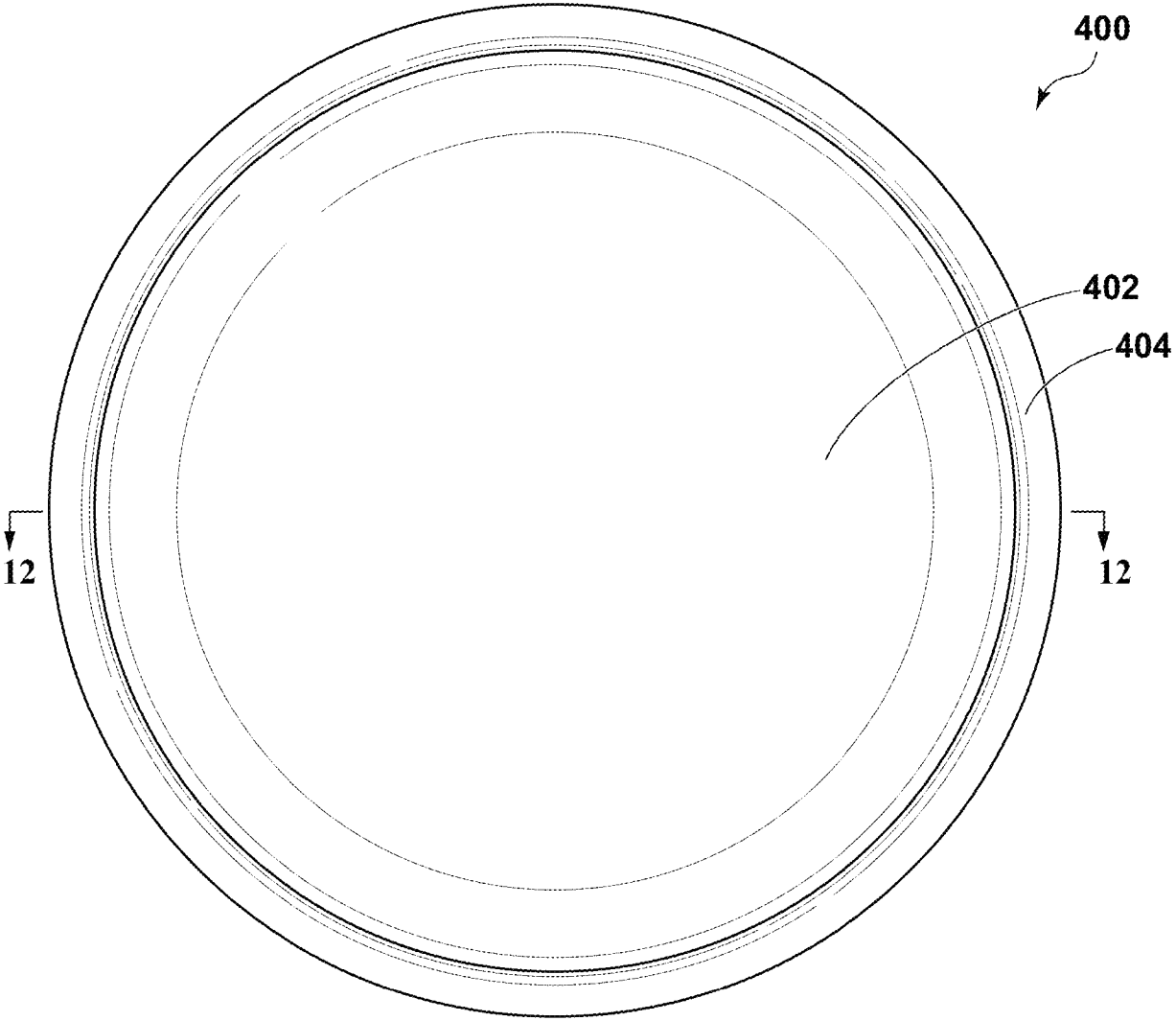
FIG. 11 is a bottom view thereof.

Referring to FIGS. 10 and 11, a lightweight flying disc is shown generally at reference numeral 400. The disc 400 has a circular, saucer-like configuration, and comprises a central flight plate 402, and an outer rim 404 that surrounds the flight plate 402.

Figure 12:
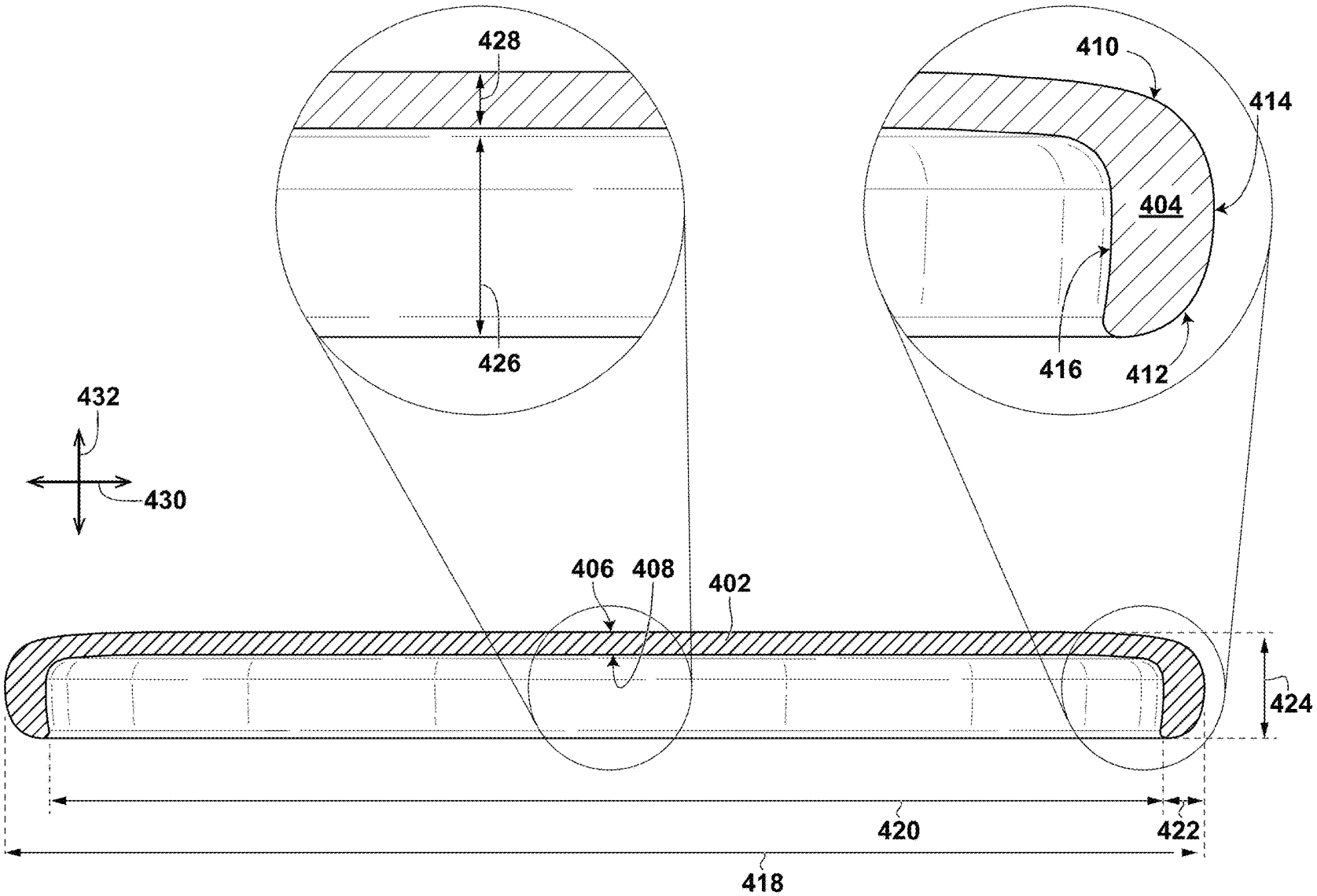
FIG. 12 is a sectional view along line 12-12 in FIG. 11.

Referring to FIG. 12, the flight plate 402 includes an upper surface 406 and a lower surface 408. The rim 404 includes an upper rim surface 410, a lower rim surface 412, and a leading edge 414 that is arranged intermediate the upper and lower rim surfaces 410, 412. The upper surface 406 adjoins the upper rim surface 410. The rim 404 further includes an inner rim wall 416 that extends between the lower surface 408 and the lower rim surface 412. Lower rim surface 412, leading edge 414, and upper rim surface 410 together can be said to have a convex shape. Inner rim wall 416 can be said to have a concave shape.

In the example illustrated, a disc diameter 418 can be defined generally as an overall width of the disc 400 in a horizontal or radial direction 430 between the leading edges 414. An inner rim diameter 420 can be defined generally as a width of the flight plate 402 in the radial direction 430. A rim width 422 can be defined generally as a width of the rim 404 in the radial direction 430. A disc height 424 can be defined generally as an overall height of the disc 400 in a vertical or axial direction 432, which is orthogonal to the radial direction 430. An inner rim height 426 can be defined generally as a height of the rim 404 in the axial direction 432 below the flight plate 402. Finally, a thickness 428 can be defined generally as a height of the flight plate 402 in the axial direction 432 at a central location of the disc 400.

Dimensions for the disc 400 are provided in Table 4. These dimensions are intended to be illustrative but non-limiting. It will be appreciated that other suitable dimensions are possible, including those hereinafter provided in Tables 5 and 6.

TABLE 4

| | | |
|---|---|---|
| Disc diameter | 418 | 245 mm |
| Inner rim diameter | 420 | 231 mm |
| Rim width | 422 | 7.0 mm |
| Disc height | 424 | 28 mm |
| Inner rim height | 426 | 17 mm |
| Central thickness | 428 | 4.5 mm |

Further exemplary dimensions for the disc 400 are provided in Tables 5 and 6. Again, these dimensions are intended to be illustrative but non-limiting, and it will be appreciated that other suitable dimensions are possible.

TABLE 5

| | | |
|---|---|---|
| Disc diameter | 418 | 210 mm |
| Inner rim diameter | 420 | 200 mm |
| Rim width | 422 | 5.0 mm |
| Disc height | 424 | 17 mm |
| Inner rim height | 426 | 11 mm |
| Central thickness | 428 | 4.0 mm |

TABLE 6

| | | |
|---|---|---|
| Disc diameter | 418 | 248 mm |
| Inner rim diameter | 420 | 232 mm |
| Rim width | 422 | 8.0 mm |
| Disc height | 424 | 30 mm |
| Inner rim height | 426 | 18 mm |
| Central thickness | 428 | 5.0 mm |

Furthermore, the total volume for the disc 400 can range from about 180 $cm^3$ to about 210 $cm^3$, and can be, for example, about 180 $cm^3$ (e.g., disc 400 in Table 5), or, for example, about 210 $cm^3$ (e.g., discs 400 in Tables 4 and 6). It will be appreciated that these are illustrative non-limiting volumes, and that other suitable volumes are possible.

Moreover, the weight of disc 400 can range from about 100 grams to about 135 grams, and can be, for example, about 100 grams (e.g., disc 400 in Table 5), about 130.0 grams (e.g., disc 400 in Table 4), or 135 grams (disc 400 in Table 6). It will be appreciated that these are illustrative non-limiting weights, and that other suitable weights are possible.

As described herein and illustrated in the drawings, it will be recognized that the discs 100, 200, 300, 400 exhibit various structural differences.

For example, in the discs 100 and 400, the flight plates 102 and 402, respectively, have a domed shape, which can be expressed as a difference between the disc height 124 and 424, respectively, minus the inner rim height 126 and 426, respectively, and the central thickness 128 and 428, respectively. The flight plate 202 has less of a domed shape, and the flight plate 302 even less, with the flight plate 302 being almost planar.

Furthermore, in the disc 100, the lower rim surface 112 of the rim 104 is provided at an angle relative to the radial direction 130 of the disc 100, presenting a sharper profile surrounding the leading edge 114. In the disc 200, the rim width 222 is less, and therefore the lower rim surface 212 is provided at a greater angle relative to the radial direction 230 of the disc 200. In the disc 300, the rim width 322 is decreased further, and therefore the lower rim surface 312 is provided at a yet greater angle, which presents more of a blunt profile surrounding the leading edge 314. In the disc 400, the rim width 422 is yet decreased further, and lower rim surface 412, leading edge 414, and upper rim surface 410 together present a convex profile.

Moreover, in the disc 100, the inner rim wall 116 flares outwardly between the lower surface 108 and the lower rim surface 112 and is slightly concave in shape. In the disc 200, the inner rim wall 216 also flares outwardly between the lower surface 208 and the lower rim surface 212 but is more linear. In the disc 300, the inner rim wall 316 does not flare outwardly but is concave in shape. In the disc 400, the inner rim wall 416 does not flare outwardly either, and is concave in shape.

Different rims 104, 204, 304 can permit different flight characteristics, which players playing a game of disc golf may seek to exploit, as different game situations present themselves. Thus, for example, comparing the combination of (a) rim widths 122, 222, 322, (b) disc heights 124, 224, 324, and (c) profiles of leading edges 114, 214, 314, it will be appreciated that wider rim width 122, shorter disc height 124, and sharper profile of leading edge 114 of the disc 100 can allow it to achieve higher velocity than the discs 200, 300, and can cover a greater distance. However, it can be more challenging for a player to achieve an intended flight path when throwing the disc 100, and, in particular, the disc 100 can be more prone to veering off from a straight-line flight path.

By way of another example of different flight characteristics when comparing the discs 100, 200, 300, it will be appreciated that narrower rim width 322, taller disc height 324, and blunter profile of leading edge 314 of the disc 300 can allow it to achieve a straighter flight path, and to be perceived more as floating in the air, than the discs 100, 200, even when the disc 300 is thrown at lower speeds. However, the flight distances which the disc 300 can achieve can be less than the flight distances achievable with the disc 100. Flight characteristics of the disc 200, such as velocity, flight distance, and ability to control flight path, can be said to be intermediate relative to those of the discs 100, 300. Thus, it will be clear that the flying discs of the present disclosure can exhibit different flight characteristics, and that players using the flying discs may select different disc designs, as desired.

By way of another example of different flight characteristics for disc 400, comparing the combination of (a) disc heights 124, 224, 324, 424, and (b) profiles of lower rim edges, 112, 212, 312, 412, leading edges 114, 214, 314, 414, and upper rim edges 110, 210, 310, 410, together, it will be appreciated longer disc height 424, and the convex profile of leading edge 414 of the disc 400 generally allow it to a achieve lower velocity than the discs 100, 200, 300, and to cover less flight distance. However, across these relatively shorter flight distances and at these relatively slower velocities, disc 400 will be more stable, and it will be easier to achieve straight flight paths, which makes disc 400 suitable for playing a game of ultimate Frisbee™, where frequently shorter distances between players are covered. In addition, the convex profile of lower rim edge 412, leading edge 414, and upper rim edge 410, together, makes disc 400 easier to catch, in particular relative to disc 100 which presents a sharper profile.

As mentioned above, two aspects of the discs 100, 200, 300, 400 that enable good flight performance are the selection of lightweight and resilient materials, and the flight plate thickness 128, 228, 328, 428 which has been adjusted to be substantially thicker as compared to typical discs.

In some examples, the discs can have a weight of 150 grams or less. In some examples, the discs can have a weight of 135 grams or less. In some examples, the discs can have a weight of 130 grams or less. In some examples, the discs can have a weight of 125 grams or less. In some examples, the discs can have a weight of 110 grams or less. In some examples, the discs can have a weight of 100 grams or less. In some examples, the discs can have a weight of 60 grams or more. In some examples, the discs can have a weight of 75 grams or more. In some examples, the discs can have a weight of 90 grams or more. In some examples, the discs can have weight of between 60 grams and 150 grams. In some examples, the discs can have weight of between 75 grams and 110 grams. In some examples, the discs can have a weight of between 90 gram and 100 grams.

In some examples, the discs 100, 200, 300, 400 can have a flexibility rating of 2.0 kg or less. In some examples, the discs 100, 200, 300, 400 can have a flexibility rating of 1.0 kg or less. In some examples, the discs 100, 200, 300, 400 can have a flexibility rating of between 750 grams and 1.0 kg. In contrast, discs manufactured of regular hard plastic materials typically have a flexibility rating from about 8.0 kg up to 12.25 kg.

Flexibility can be tested by holding a disc on its edge in a vertical position perpendicular to a scale with a precision of at least 2 oz. (56.7 g). The upper rim of the disc can then gradually be pressed down within 5 seconds. The flexibility rating can be then determined in one of two ways, depending on how the disc reacts to the applied pressure. For discs that buckle, the flexibility rating can correspond to the point when the maximum weight is registered on the scale. For discs that do not buckle, the rating can refer to the weight at the point when the inside rim-to-rim distance (i.e., 120, 220, 320, 420 for discs 100, 200, 300, 400 respectively) is at 50 percent of the disc's diameter (i.e., 118, 218, 318, 418 for discs 100, 200, 300, 400, respectively). Discs that buckle above 12.25 kg and discs that are unable to be bent to 50% of their diameters fail the flexibility test. The temperature of the disc is to be no higher than 25 degrees Celsius (77 F) when the flexibility test is performed. The ratings of three samples can be determined, and the median score can used as the final rating. Manufacturers are required to send samples of the most rigid discs they want considered for PDGA approval.

In some examples, the discs 100, 200, 300, 400 can be manufactured from a foam material. In some examples, the discs 100, 200, 300, 400 can be manufactured from a polyurethane foam. In some examples, the polyurethane can have a density of from 0.40 gram/cm$^3$ to 0.60 gram/cm$^3$. In some examples, the polyurethane can have a density of about 0.48 gram/cm$^3$.

In some examples, the discs 100, 200, 300, 400 can be manufactured from a material selected from the group consisting of an impact protection polyurethane foam, a viscoelastic slow recovery memory polyurethane foam, a poured polyurethane foam, a flexible polyurethane foam, and combinations thereof. In some examples, the discs 100, 200, 300, 400 can be manufactured from an ethylene vinyl acetate (EVA) foam. In some examples, the discs 100, 200, 300, 400 can be manufactured from a styrene butadiene rubber (SBR) foam. In some examples, the discs 100, 200, 300, 400 can be manufactured from a cross-linked polyethylene foam (XPE) foam.

In some examples, the discs 100, 200, 300, 400 can be manufactured so that the flight plate and the rim are formed integrally of the same material. In some examples, the discs 100, 200, 300, 400 can be manufactured so that the flight plate and the rim are formed separately of the same material, and then assembled. In some examples, the discs 100, 200, 300, 400 can be manufactured so that the flight plate and the rim are formed separately of different materials, and then assembled. In some examples, the discs 100, 200, 300, 400 can be manufactured so that at least the flight plate is manufactured from a lightweight and resilient material, including, a foam, for example, having a density of 0.40 gram/cm$^3$ to 0.60 gram/cm$^3$.

Depending on material(s), different manufacturing methods can be utilized. In some examples, the discs 100, 200, 300, 400 of the present disclosure can be manufactured using a foam molding process, which involves injecting a viscous liquid into a mold and letting the material harden in the mold. Using a foam molding process, it is possible to readily achieve some geometrical features of the lightweight discs of the present disclosure. Thus, for example, the discs of the present disclosure can include, for example, a concave inner rim, as illustrated, for example, by inner rim walls 316 and 416 of discs 300 and 400, respectively. Discs with a concave inner rim can formed using a foam molding process. In contrast, when hard plastic discs are manufactured using a typical injection molding process, the presence of a concave inner rim can prevent the removal of the disc from the mold or die. Hence, it can be challenging to manufacture hard plastic discs having a concave inner rim.

In some examples, the flight plate can have a central thickness of 3.5 mm or more. In some examples, the flight plate can have a central thickness of 4.0 mm or more. In some examples, the flight plate can have a central thickness of 7.0 mm or less. In some examples, the flight plate can have a central thickness of 6.0 mm or less. In some examples, the flight plate can have a central thickness of 5.0 mm or less. In some examples, the flight plate can have a central thickness of 4.5 mm or less. In some examples, the flight plate can have a central thickness of between 3.5 mm and 7.0 mm. In some examples, the flight plate can have a central thickness of between 3.9 mm and 4.5 mm. In some examples, the flight plate can have a central thickness of between 3.9 mm and 4.2 mm.

In the specific exemplary discs 100, 200, 300, 400, with the central thickness 128, 228, 328, 428 of the flight plate 102, 202, 302, 402 being 4.20 mm, 4.09 mm, 3.90 mm, and ranging from 4 to 5 mm respectively, respectively, in combination with material selection and the other dimensions, the inventor has found that the discs 100, 200, 300, 400 have good flight characteristics and sufficient rigidity to avoid collapse during use.

For discs formed of regular hard plastic materials, one of the manufacturing challenges is material distribution so that the discs do not exceed the maximum allowable weight (including, for example, compliance with the Professional Disc Golf Associate Technical Standards). In practice, this can mean that the flight plate is designed to be as thin as possible. In contrast, for the discs 100, 200, 300, 400 of the present disclosure, exceeding the total allowable mass is less of a concern because the density of the material is so much lower.

Moreover, the total volume of the discs of the present disclosure can exceed the volume of typical discs manufactured from hard plastic materials. Thus, the discs of the present disclosure can be characterized by having, in some examples, a volume of 180 $cm^3$ or more. In some examples, the discs of the present disclosure can have a volume of between 180 $cm^3$ and 240 $cm^3$. In the specific examples herein, the discs can have a volume of about 204.9 $cm^3$ (disc 100), about 204.4 $cm^3$ (disc 200), about 188.5 $cm^3$ (disc 300), or from about 180 $cm^3$ to about 210 $cm^3$ (disc 400).

The inventor has emphasized that it is surprising that the discs of the present disclosure fly as well as they do, despite being lightweight. In this respect, the inventor has noted that, prior to his discovery of the instant disc designs, it was expected that a reduction in disc weight would result in decreased flight stability, and, in particular, would substantially compromise a flat flight trajectory, notably when discs are thrown forcefully. Surprisingly, however, the discs of the present disclosure, despite being lightweight, maintain flight stability, even when thrown forcefully. Furthermore, it will be appreciated that players of various ages and levels may be able to throw the discs further as compared to a hard plastic disc, because they are so light. Moreover, the discs of the present disclosure may be easier and safer to catch, because they are lightweight. A yet further beneficial feature of the lightweight discs of the present disclosure is that the risk of injury when a person is accidently hit by a disc is substantially lower than when being hit by a hard plastic disc. For at least these reasons, the lightweight discs of the present disclosure can be suitable for younger and less experienced players, and for the purpose of teaching younger and less experienced players flying disc sports.

While the above description provides examples of one or more apparatuses or methods, it will be appreciated that other apparatuses or methods may be within the scope of the accompanying claims.

I claim:

1. A lightweight flying disc for a recreational game or flying disc sport, comprising:

a flight plate portion; and a rim portion surrounding the flight plate portion, wherein at least the flight plate portion is formed of a lightweight and resilient material, wherein the lightweight and resilient material consists of a foam, wherein the flight plate portion has a central thickness of between 3.5 mm and 7.0 mm, and wherein an inner rim height of the rim portion below the flight plate portion exceeds the central thickness of the flight plate portion.

2. The lightweight flying disc of claim 1, wherein the lightweight and resilient material is selected from the group consisting of:

a polyurethane foam;

a material selected from the group consisting of an impact protection polyurethane foam, a viscoelastic slow recovery memory polyurethane foam, a poured polyurethane foam, a flexible polyurethane foam, and combinations thereof;

an ethylene vinyl acetate (EVA) foam;

a styrene butadiene rubber (SBR) foam; and a cross-linked polyethylene foam (XPE) foam.

3. The lightweight flying disc of claim 1, wherein the lightweight and resilient material has a density of from 0.40 gram/$cm^3$ to 0.60 gram/$cm^3$.

4. The lightweight flying disc of claim 1, wherein the lightweight and resilient material has a density of 0.48 gram/$cm^3$.

5. The lightweight flying disc of claim 1, wherein the flight plate portion and the rim portion are formed integrally of the same material.

6. The lightweight flying disc of claim 1, wherein the flight plate portion has the central thickness of between 3.9 mm and 4.2 mm.

7. The lightweight flying disc of claim 1, wherein the flight plate portion has the central thickness of between 3.9 mm and 5.0 mm.

8. The lightweight flying disc of claim 1, wherein a disc diameter is between 210 mm and 248 mm, or between 210.78 mm and 216.19 mm.

9. The lightweight flying disc of claim 1, wherein an inner rim diameter is between 172.49 mm and 232 mm, or between 172.49 mm and 192.80 mm.

10. The lightweight flying disc of claim 1, wherein a rim width is between 5.0 mm and 19.66 mm, or between 9.50 mm and 19.66 mm.

11. The lightweight flying disc of claim 1, wherein a disc height is between 17 mm and 30 mm, or between 17.51 mm and 18.45 mm.

12. The lightweight flying disc of claim 1, wherein the inner rim height is between 11 mm and 18 mm, or between 11.05 mm and 13.94 mm.

13. The lightweight flying disc of claim 1, wherein the disc has a weight of 135 grams or less.

14. The lightweight flying disc of claim 1, wherein the disc has a weight of 130 grams or less.

15. The lightweight flying disc of claim 1, wherein the disc has a weight of 125 grams or less.

16. The lightweight flying disc of claim 1, wherein the disc has a weight of 110 grams or less.

17. The lightweight flying disc of claim 1, wherein the disc has a weight of 100 grams or less.

18. The lightweight flying disc of claim 1, wherein the disc has a weight of between 60 grams and 150 grams.

19. The lightweight flying disc of claim 1, wherein the disc has a weight of between 75 grams and 130 grams.

20. The lightweight flying disc of claim 1, wherein the disc has a weight of between 75 grams and 110 grams.

21. The lightweight flying disc of claim 1, wherein the disc has a weight of between 90 grams and 100 grams.

22. The lightweight flying disc of claim 1, wherein the disc has a volume of 180 $cm^3$ or more.

23. The lightweight flying disc of claim 1, wherein the disc has a volume of between 180 $cm^3$ and 240 $cm^3$.

24. The lightweight flying disc of claim 1, wherein the disc has a flexibility rating of 2.0 kg or less, or 1.0 kg or less, or between 750 g and 1.0 kg.

25. A lightweight flying disc for a recreational game or flying disc sport, comprising:

a flight plate portion; and a rim portion surrounding the flight plate portion, wherein at least the flight plate portion is formed of a lightweight and resilient material, wherein the lightweight and resilient material consists of a foam, having a density of from 0.40 gram/$cm^3$ to 0.60 gram/$cm^3$, the flying disc having a weight of between 60 grams and 150 grams, and a volume of 180 $cm^3$ or more, wherein the flight plate portion has a central thickness of between 3.9 mm and 5.0 mm, and wherein an inner rim height of the rim portion below the flight plate portion exceeds the central thickness of the flight plate portion.

26. A lightweight flying disc for a recreational game or flying disc sport, comprising:

a flight plate portion; and a rim portion surrounding the flight plate portion, wherein the flying disc is formed of a lightweight and resilient material, wherein the lightweight and resilient material consists of a foam having a volume of 204.9 $cm^3$, an inner rim diameter of 172.49 mm, and a central thickness of 4.20 mm, wherein the disc weighs 100.0 grams, and wherein an inner rim height of the rim portion below the flight plate portion exceeds the central thickness.

27. A lightweight flying disc for a recreational game or flying disc sport, comprising:

a flight plate portion; and a rim portion surrounding the flight plate portion, wherein the flying disc is formed of a lightweight and resilient material, wherein the lightweight and resilient material consists of a foam having a volume of 188.5 $cm^3$, wherein the disc has a concave inner rim wall and an inner rim diameter of 192.80 mm, and a central thickness of 3.90 mm, wherein the disc weighs 92.2 grams, and wherein an inner rim height of the rim portion below the flight plate portion exceeds the central thickness.

* * * * *